United States Patent [19]

Turner

[11] Patent Number: 4,813,933

[45] Date of Patent: Mar. 21, 1989

[54] ORAL FEEDING APPLIANCE

[75] Inventor: John J. Turner, Liverpool, England

[73] Assignee: National Research Development Corporation, London, England

[21] Appl. No.: 79,775

[22] PCT Filed: Oct. 28, 1986

[86] PCT No.: PCT/GB86/00667

§ 371 Date: Jun. 29, 1987

§ 102(e) Date: Jun. 29, 1987

[87] PCT Pub. No.: WO87/02579

PCT Pub. Date: May 7, 1987

[30] Foreign Application Priority Data

Oct. 29, 1985 [GB] United Kingdom ..... 8526631
Jan. 16, 1986 [GB] United Kingdom ..... 8600988

[51] Int. Cl.[4] ..... A61J 7/00
[52] U.S. Cl. ..... 604/79
[58] Field of Search ..... 604/77–79, 604/244, 415, 251, 174; 215/11.1, 11.4; 248/103–106, 51, 121, 122, 125; 128/136, 359, 360; 222/80, 185

[56] References Cited

U.S. PATENT DOCUMENTS

| | | | |
|---|---|---|---|
| 2,589,504 | 3/1952 | Miller | 128/136 |
| 2,653,609 | 9/1953 | Smith | 604/415 |
| 3,165,241 | 1/1965 | Curry | 222/490 |
| 3,187,746 | 6/1965 | Gerber | 128/136 |
| 3,587,934 | 6/1971 | Elmore | 222/529 |
| 3,669,101 | 6/1972 | Kleiner | 604/77 |
| 3,995,796 | 12/1976 | Kline | 248/121 |
| 4,114,847 | 9/1978 | Bogensberger | 248/104 |
| 4,301,934 | 11/1981 | Forestal | 215/11 D |

FOREIGN PATENT DOCUMENTS

| | | | |
|---|---|---|---|
| 3247074 | 5/1984 | Fed. Rep. of Germany . | |
| 8301381 | 4/1983 | PCT Int'l Appl. | 215/11.4 |
| 2067416 | 7/1981 | United Kingdom . | |

*Primary Examiner*—John D. Yasko
*Assistant Examiner*—J. L. Kruter
*Attorney, Agent, or Firm*—Cushman, Darby & Cushman

[57] ABSTRACT

A device for administering oral fluid to a patient from a container (18) has a nipple (14) connected to the container (18) by a tube (16). The nipple (14) is provided with a soft reticulate mouthpiece (10) which fits between the lips and the gums or teeth to hold the nipple (14) on the patient's tongue. A valve (22) opens in response to the patient sucking or pressing the nipple (14) to admit fluid into the patient's mouth.

20 Claims, 2 Drawing Sheets

ORAL FEEDING APPLIANCE

FIELD OF THE INVENTION

The present invention relates to a device for administering oral fluids.

The monitoring of an adequate intake of fluids is vital to the care of all who are ill or who, because of physical or mental disability, have an impaired ability to drink normally. Individual feeding of such patients is time consuming and imposes a great strain on nursing resources. Alternative methods of administering fluids are intravenous and nasal tubes and such alternatives may be used inappropriately because of lack of a suitable system or facility for the administration of oral feeds.

DESCRIPTION OF THE PRIOR ART

U.S. Pat. No. 4,301,934 describes an infant feeding device in which a teat is connected by a tube to an inverted feeding bottle. The infant can grasp the teat at will and place it in his or her mouth. The teat protrudes from a rigid disc which is too large to enter the infant's mouth, so avoiding any risk of the infant swallowing the teat. In the case of invalids, such an arrangement would not be satisfactory as the patient may not be able to place a feeder in his or her mouth or even may be of a mind to reject the feeder.

SUMMARY OF THE INVENTION

According to the present invention, a device for administering oral fluid to a patient comprises a nipple, mouthpiece shaped to be received between the lips and the teeth or gums of the patient to hold the nipple in the patient's mouth, a container for the oral fluid and a tube leading from the container to the nipple.

Normally, the container will be supported, preferably on a stand, at a level slightly above the patient's head, so that the oral fluid will be delivered to the nipple under gravity. The nipple or the tube preferably contains a valve to prevent the fluid from flowing freely out of the nipple. Such valve may be operable by the patient by the application of suction to the nipple and/or by manipulation by the patient, e.g. by tongue pressure.

Preferably, the mouthpiece is soft and is adapted to be received between the lips and the gums. It is of such a design that it can be retained by the dentulous, the edentulous or by a patient wearing dentures. Advantageously, the mouthpiece is recticulate or otherwise air pervious so that the mouthpiece does not impede mouth breathing.

It is recommended that the nipple should be positioned on the mouthpiece such that the nipple will lie on the tongue to stimulate a sucking action by the patient.

Conveniently, the container is closed by a rubber diaphragm which can be pierced by a hollow non-coring needle on the inlet end of the tube and which is selfresealing so that the hollow needle can be withdrawn and re-inserted several times, rather like the closure of a conventional blood transfusion or intravenous feed supply. This enables the tube to be disconnected, when not in use, and to be flushed with a suitable disinfectant, such as a mouthwash liquid.

Preferably, the stand incorporates a receptacle to receive a disinfectant, such as mouthwash liquid, in which the mouthpiece can be placed when not in use.

The container may have a closeable top to enable it to be filled just before use or to be re-filled, if desired. Alternatively, the container could be a pre-pack.

The device of the invention would normally be disposable. In many cases it would be discarded no longer than twentyfour hours after first being put in use, but would be used several times within this period, the mouthpiece being immersed in disinfectant when not in use and the tube being flushed with disinfectant between periods of use.

BRIEF DESCRIPTION OF THE DRAWINGS

The invention will be further described, by way of example, with reference to the accompanying drawings, in which.

DESCRIPTION OF THE PREFERRED EMBODIMENTS

Figure 1:
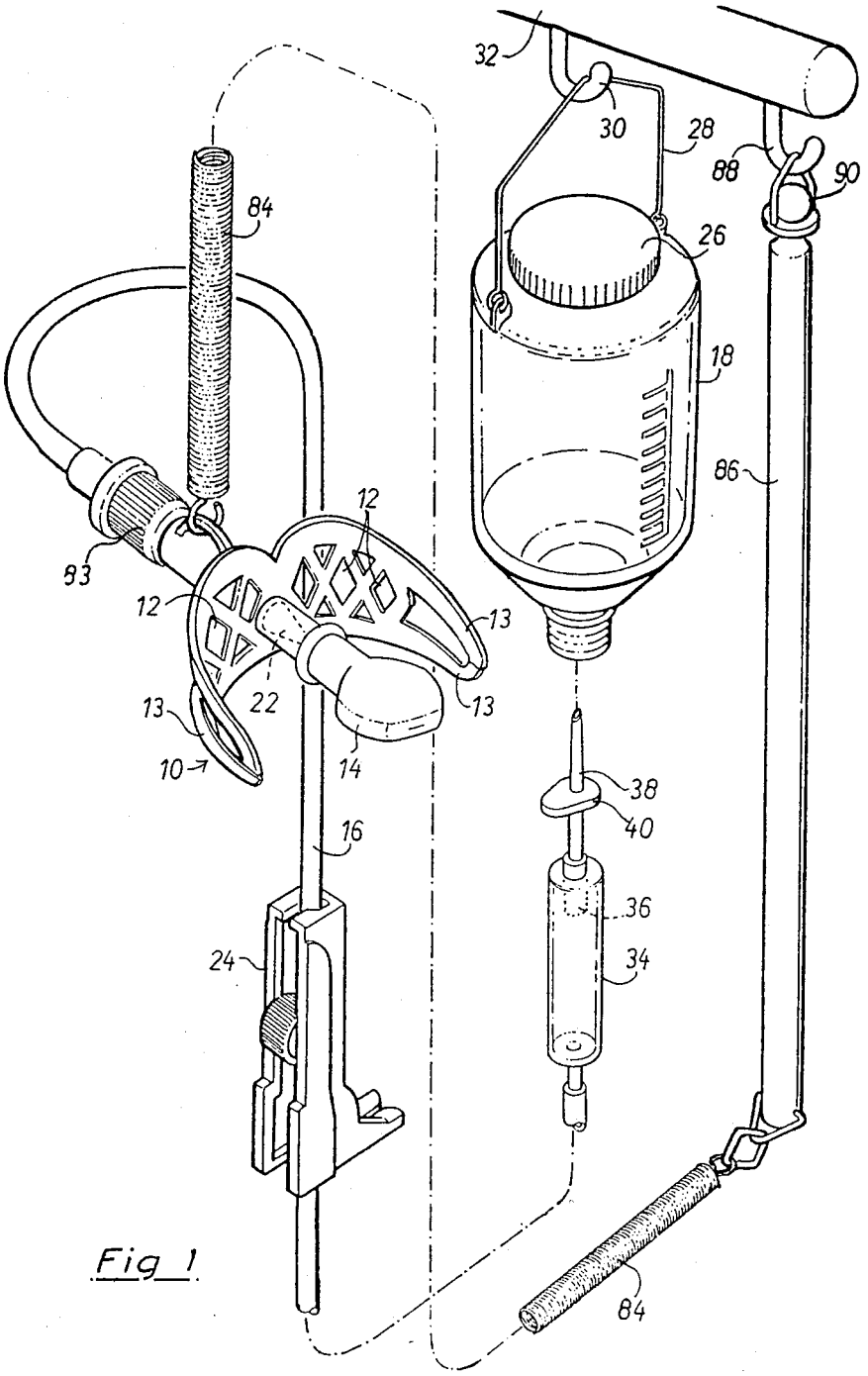
FIG. 1 is a somewhat diagrammatic perspective view of a device for administering oral fluid in accordance with the invention.

The device shown in FIG. 1 of the drawings comprises a soft mouthpiece 10 which is designed to be retained between the lips and the gums of the patient and is so shaped as to be soft and comfortable. The mouthpiece 10 is suitably designed to be air pervious so as not to inhibit the patient from breathing through the mouth. To this end it may be designed as a lattice-like structure to define openings 12. So that the mouthpiece 10 will fit patients with different sized and shaped mouths, it is made extremely flexible and includes two tapering side portions 13 at each side, these side portions converging towards one another but without touching one another in the free state.

The mouthpiece 10 is provided with a nipple 14 which projects sufficiently far for it to be received on the tongue of the patient. The nipple 14 is preferably of a somewhat flattened or oblate shape. It is connected by a flexible tube 16 to a container or reservoir 18 which can be suspended from an arm 32 of a stand 20 (FIG. 2) so as to be at a level slightly higher than the level of the patient's head. Oral fluid in the reservoir 18 is thus delivered to the nipple 14 at slight excess pressure but to prevent the fluid from dribbling out of the nipple the nipple is provided with a valve 22 which is designed to remain closed under a slight pressure head but to be opened when the patient applies suction to the nipple 14. As an additional precaution when the device is not in use the tube 16 can be closed by means of a separate valve, for example in the form of a tube clamp 24.

The mouthpiece 10 can be designed to provide a maximum degree of comfort since it does not need to be very strong.

The whole of the device will normally be designed to be disposable and thus the reservoir 18 will usually be a plastics bottle having a filler cap 26. It is even possible for the reservoir to be prefilled provided that the fluid is properly sterilized. The plastics bottle is shown with a wire suspension loop 28 but such a loop could be moulded integrally with the bottle or alternatively a suitable cord could be provided.

Whilst the reservoir 18 is shown suspended from a hook 30 on the arm 32 of the stand 20 it is not necessary to provide a separate stand. The reservoir 18 could, for example, be suspended from the head of the patient's bed.

To enable the rate of consumption of the oral fluid by the patient to be observed, the flexible tube 16 is connected to a sight tube 34 into which the oral fluid drips from an inlet nozzle 36. The lower end of the reservoir 18 is closed by a rubber diaphragm (not visible) which can be pierced by a pointed hollow, preferably non-coring needle 38. To this end, the hollow needle 38 is formed integrally with a handle 40. The inlet nozzle 36 to the sight tube 34 comprises the outlet end of the hollow needle 38.

The hollow needle 38, together with the handle 40, will usually be moulded from plastics material and the sight tube 34 will usually be made of transparent plastics material. The reservoir 18 can be calibrated, as shown, to enable the amount of oral fluid in the reservoir 18 to be measured.

Figure 2:
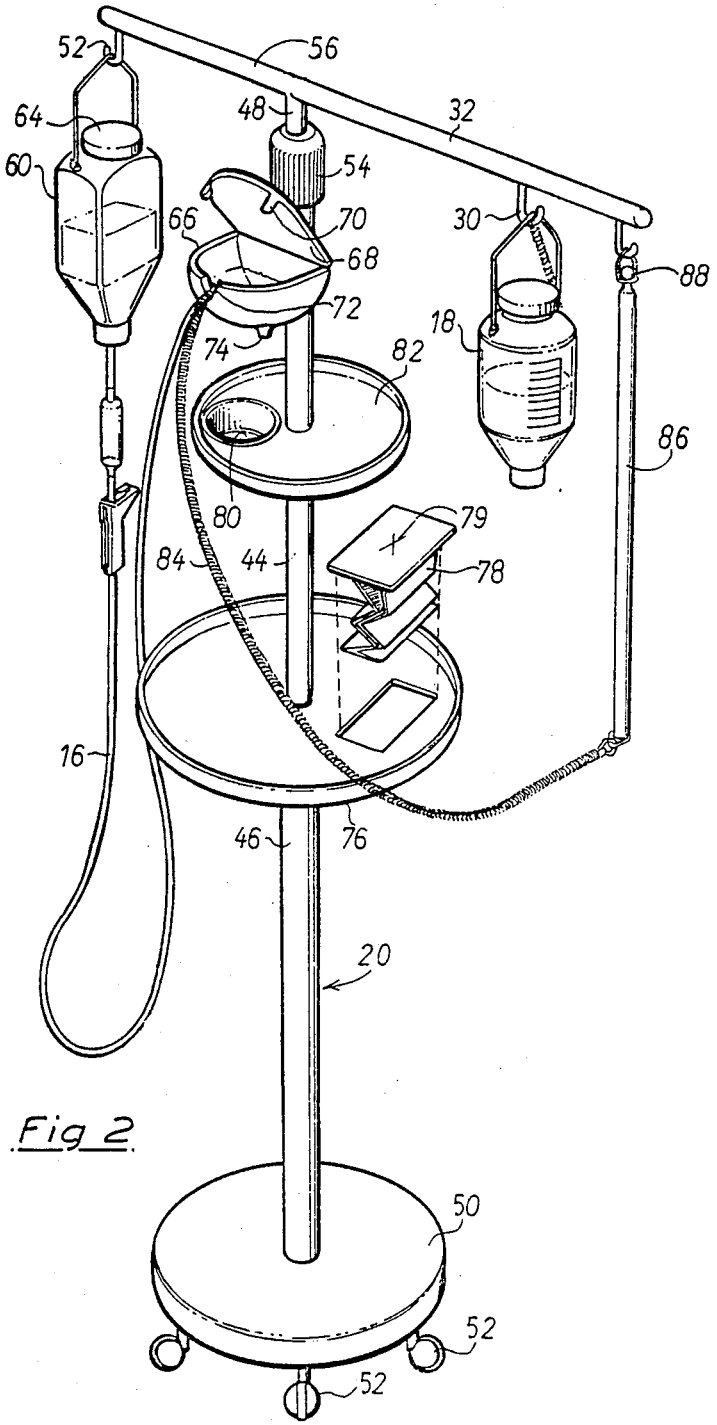
FIG. 2 is a perspective view of the device on a stand, when not in use.

The rubber diaphragm closing the lower end of the reservoir 18 is of a kind which re-closes when the needle 38 is removed, so enabling the tube 16 to be disconnected from the reservoir 18 when not in use, as shown in FIG. 2.

The stand 20 shown in FIG. 2 comprises an upright column 44 formed of telescopic tubes 46 and 48. The lower tube 46 is provided with a heavy base 50 having castors 52 on its lower side. Upper inner tube 48 is slidably received in lower outer tube 46 and can be locked in any desired adjusted position within limits by means of a collet 54.

The arm 32 and another arm 56 are attached to the upper end of the upper tube 48. The reservoir 18 containing some oral fluid is shown in FIG. 2 suspended from the hook 30 but with the tube 16 detached therefrom and instead attached to a disinfectant bottle 60 suspended from a hook 52 on the arm 56. Like the reservoir 18, the bottle 60 is closed at its lower end by a rubber diaphragm which can be pierced by the hollow needle 38. The bottle 60 can be re-filled with disinfectant as necessary and its top can be closed by a screw-top lid 64.

Whilst it is preferable for the reservoir 18 to be of clear transparent, uncoloured plastics material in order that its contents can be observed accurately, it is preferable to make the bottle 60 for disinfectant of a distinctive colour and/or a distinctive shape and/or distinctively marked, yet still sufficiently transparent to enable the level of the disinfectant to be observed.

A receptacle 66 is attached to the upper end of the lower tube 46 at a convenient height for adequate observation in use and is shaped to receive the mouthpiece 10 when the device is not in use. A transparent lid 68 is provided for closing the receptacle 66 and has resilient tabs 70 for releasably holding the lid 68 closed. The front wall of the receptacle 66 is formed with a notch 72 through which the tube 16 passes. The receptacle 66 will normally contain a suitable disinfectant so that the mouthpiece remains immersed in the disinfectant when the device is not in use. The lowermost part of the receptacle 66 is provided with a stopper 74 which can be removed to enable the receptacle to be drained and cleaned.

Conveniently, a table 76 is attached to the lower tube 46 of the stand 20 and has an aperture shaped to receive a self-sealing expandible disposable collection bag 78 of lightweight foil plastics or other suitable material. The self-sealing aperture 79 will receive the tube 16 and allow collection of the antiseptic fluid and other fluid residues from the tube 16. A second table 82 is situated above the table 76 and is also attached to the lower tube 46. The table 82 can be provided with one or more apertures, one being shown, to locate a bowl or receiver 80 containing a suitable fluid for rinsing antiseptic residues from the mouthpiece 10 prior to insertion in the patient's mouth. Bottles of disinfectant, medicaments etc., which the nursing staff require to use from time to time, can be placed on the tables 76,82.

A "Luer" or similar type of locking joint 83 allows the mouthpiece 10 to be detached from the tube 16, in order to allow all antiseptic and other fluid residues to be drained from the tube and the mouthpiece before insertion into the patient's mouth and the elimination of rehydrating fluids.

After use of the device according to the invention, the tube 16 can be detached from the reservoir 18 and instead be attached to the bottle 60 of disinfectant. The mouthpiece is then lowered to a point just above the collecting bag 78 whereupon a sufficient pressure is developed at the valve 22 (FIG. 1) to open the valve so that disinfectant will pass through the tube 16 and mouthpiece 10 to flush out the oral fluid remaining therein. Thereafter, the tube clamp 24 is closed and the mouthpiece 10 is placed in the receptacle 66.

Before the next use of the device, the tube 16 is detached from the bottle 60 and from the mouthpiece 10 and the clamp 24 is released with the lower end of the tube 16 inserted in the collection bag 78 to drain at least some of the disinfectant out of the tube. Thereafter, the tube is attached to the reservoir 18 and, with the end of the tube still held in the bag 78, the clamp 24 is opened in order that some of the oral fluid from the reservoir 18 can be used to purge any remaining disinfectant from the tube 16. The mouthpiece 10 is then re-attached and the device is ready for use by the patient as described above with reference to FIG. 1.

It is advantageous for the mouthpiece 10 to be restrained from falling on the floor or becoming lost in the bedclothes, should it be removed by the patient from his mouth. To this end, a light elastic cord or spiral spring 84 extends from a rod 86 suspended from a hook 88 on the stand 20 and can be releasably hooked onto the mouthpiece. In a preferred arrangement, the rod 86 is attached by one end to the stand by means of a swivel joint 90.

Whilst the use of a valve has been described, wherein the valve is opened by suction or mechanically by the patient's tongue pressure or both, it is feasible to employ instead, a valve which is electromagnetically operated or operated by a fluid pressure from a control device. A pressure transducer is connected to the tube so as to respond to a reduction in pressure when the patient sucks and to apply a signal to the control device which accordingly opens the valve. The control device can be adapted to meter the fluid in predetermined doses, independent of the strength or duration of sucking by the patient, thereby ensuring that the patient receives an amount of fluid which is adequate, yet not so great that the patient might choke.

The device of the present invention is particularly useful for patients who have undergone major surgery and have necessarily been fed intravenously for several days and who must be weaned back on to ordinary foods. Such patients are usually extremely ill and drowsy and unable to drink fluids without assistance. The use of the device of the invention in such circumstances frees the nursing staff for other duties.

I claim:

1. A device for administering an ingestible oral fluid to a patient, comprising a nipple, a container for the oral fluid and a tube leading from the container to the nipple, characterised in that the nipple extends from a flexible air-pervious mouthpiece which does not impede mouth breathing and which is shaped to be received between the lips and the teeth or gums of the patient so as to hold the nipple in the patient's mouth.

2. A device according to claim 1, in which the nipple or the tube contains a valve which is normally closed to prevent the fluid from flowing freely out of the nipple.

3. A device according to claim 2, in which the valve is operable by the patient.

4. A device according to claim 3, in which the valve is operable by the application of suction to the nipple.

5. A device according to claim 3, in which the valve is actuable by the application of tongue pressure to the nipple.

6. A device according to claim 1, in which the mouthpiece is soft and/or flexible.

7. A device according to claim 1, in which the mouthpiece is of such a design that it can be retained by the dentulous, the edentulous or by a patient wearing dentures.

8. A device according to claim 1, in which the mouthpiece is reticulate.

9. A device according to claim 1, in which the mouthpiece positions the nipple such that the nipple will lie on the tongue to stimulate a sucking action by the patient.

10. A device according to claim 1, in which the container is closed by a rubber diaphragm which can be pierced by a hollow non-coring needle on the inlet end of the tube and which is self-resealing.

11. A device according to claim 1, which is disposable.

12. A device according to claim 1, in which the container is supported on a stand so as to be at a level slightly above the patient's head, whereby the oral fluid will be delivered to the nipple under gravity.

13. A device according to claim 12, in which the stand incorporates a receptacle to receive a disinfectant, such as mouthwash liquid, in which the mouthpiece can be placed when not in use.

14. A device according to claim 12, in which the container has a closeable top to enable it to be filled.

15. A device according to claim 12, in which the container is supplied filled with oral fluid.

16. A device according to claim 12, in which the mouthpiece is connected to the stand by resiliently extendible means.

17. A device according to claim 12, in which the stand is adapted to support a disposable collection bag for fluid residues.

18. A device according to claim 12, in which the stand is provided with a receiver for rinsing fluid.

19. A device for administering an ingestible oral fluid, comprising a nipple, a container for the oral fluid and a tube leading from the container to the nipple, characterised in that the nipple extends from a flexible air-pervious mouthpiece which does not impede mouth breathing and which is shaped to be received between the lips and the teeth or gums of the patient so as to hold the nipple in the patient's mouth, said container being supported on a stand so as to be at a level slightly above the patient's head, whereby the oral fluid will be delivered to the nipple under gravity, said stand further having thereon a disinfectant bottle to which the tube can be coupled, after detachment from the container, for flushing at least the tube.

20. A device for administering an ingestible oral fluid, comprising a nipple, a container for the oral fluid and a tube leading from the container to the nipple, characterised in that the nipple extends from a flexible air pervious reticulate mouthpiece which does not impede mouth breathing and which is shaped to be received and retained between the lips and the teeth or gums of the patient whether dentulous, edentulous or wearing dentures, so as to hold the nipple in the patient's mouth such that the nipple will lie on the tongue to stimulate a sucking action by the patient, and in that said nipple or the tube further contains a valve which valve is normally closed to prevent the fluid from flowing freely out of the nipple.

* * * * *